US007488255B2

(12) United States Patent
Labes

(10) Patent No.: US 7,488,255 B2
(45) Date of Patent: Feb. 10, 2009

(54) INTERLOCKABLE TELESCOPIC BATON

(75) Inventor: Holger Labes, Kaiserslautern (DE)

(73) Assignee: Wolfgang Bopp, Mainz (DE)

( * ) Notice: Subject to any disclaimer, the term of this patent is extended or adjusted under 35 U.S.C. 154(b) by 155 days.

(21) Appl. No.: 10/554,358

(22) PCT Filed: Apr. 27, 2004

(86) PCT No.: PCT/DE2004/000876

§ 371 (c)(1),
(2), (4) Date: Aug. 22, 2006

(87) PCT Pub. No.: WO2004/097328

PCT Pub. Date: Nov. 11, 2004

(65) Prior Publication Data

US 2007/0087844 A1 Apr. 19, 2007

(30) Foreign Application Priority Data

Apr. 29, 2003 (DE) ..... 203 06 698 U

(51) Int. Cl.
*F41B 15/02* (2006.01)

(52) U.S. Cl. ..... 463/47.7; 135/75

(58) Field of Classification Search ..... 463/47.2, 463/47.7; 135/68–70, 72, 75; 403/367, 368, 403/377

See application file for complete search history.

(56) References Cited

U.S. PATENT DOCUMENTS

| | | | | |
|---|---|---|---|---|
| 4,037,839 | A * | 7/1977 | Nelson | 463/47.7 |
| 4,254,423 | A | 3/1981 | Reinhard | |
| 4,819,137 | A * | 4/1989 | Hamilton | 362/102 |
| 5,031,827 | A * | 7/1991 | von Braunhut | 231/3 |
| 5,961,387 | A * | 10/1999 | Parsons | 463/47.7 |
| 6,238,292 | B1 * | 5/2001 | Pelkey | 463/47.7 |

FOREIGN PATENT DOCUMENTS

| | | |
|---|---|---|
| EP | 0 145 096 A2 | 6/1985 |
| EP | 0 961 097 A2 | 12/1999 |

* cited by examiner

*Primary Examiner*—William M Pierce
(74) *Attorney, Agent, or Firm*—The Webb Law Firm

(57) ABSTRACT

The invention relates to a baton comprising at least two tube pieces, an outer tube piece and an inner tube piece which can be inserted into each other like a telescope and are interlockable in both the retracted and the deployed position. A radially displaceable locking top is disposed in the final region of the inner tube piece, which can be inserted into the outer tube piece, while a circumferential catching groove is arranged on the inside of the final region of the outer tube piece. The locking top is composed of several parts that are embodied like sectors of a circle and are joined so as to form a ring while the locking cap extends past the final region of the inner tube piece by means of a locking bulb. An expanding cone for the locking top is placed in side the inner tube piece across from the catching groove for the locking bulb, said expanding cone being movable to a limited extent in an axial direction and being fixed at the end of a positioning rod.

11 Claims, 2 Drawing Sheets

INTERLOCKABLE TELESCOPIC BATON

Figure 1:
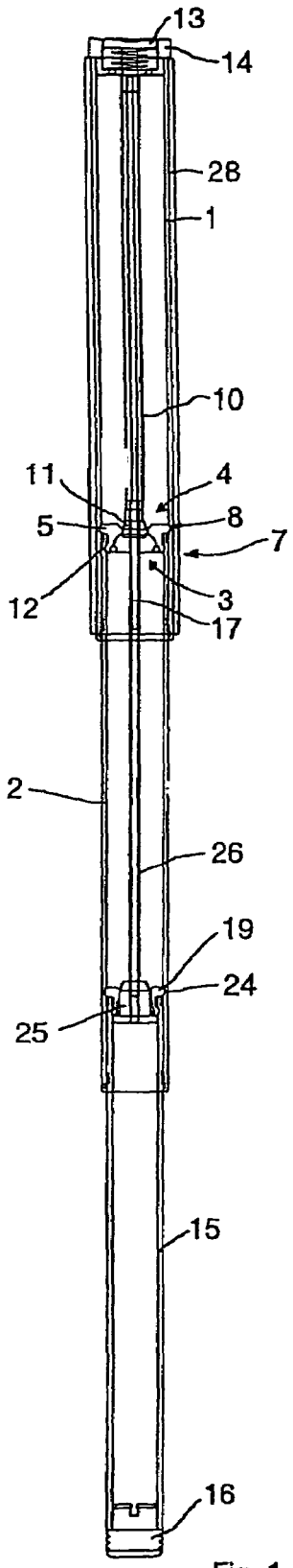

The invention pertains to a baton according to the preamble of Claim 1.

Batons of this type are known, particularly in the form of police gear, from EP 0 961 097 A2. In this case, the interlocking mechanism between the at least two tube sections is realized with the aid of spring-loaded balls. This interlocking mechanism requires much space in the radial direction and consequently results in a correspondingly large diameter, i.e., the tube section that can be extended from the tube section forming the handle has a correspondingly small diameter, particularly if such a baton is conventionally composed of three telescopic tube sections in order to simplify the stowing and carrying thereof. However, this causes the striking force to be transformed into a correspondingly high percussion on the respective person and therefore increases the risk of personal injuries. This contradicts the true purpose of batons as relatively harmless defensive and disincentive weapons when they are used by police to maintain order, for example, during escalating demonstrations.

Based on batons of the initially cited type, the invention aims to design and improve these batons in such a way that fewer components are required and, in particular, higher forces can be absorbed and transmitted by the interlocking mechanism. Another objective of the invention consists of realizing the tube section(s) that can be extended from the baton handle section such that it/they only has/have a slightly smaller diameter than the handle section despite the interlocking elements to be accommodated therein, i.e., the second or third effective tube section still has a comparatively large outside diameter. It should also be possible to easily disengage the respective interlocking mechanism in order to retract the baton.

According to the invention, this objective is attained with a baton of the initially described type that is realized in accordance with the characteristics disclosed in the characterizing portion of Claim 1.

The locking crown according to the invention is composed of a number of preferably identical (individual) parts that are realized in the form of sectors of a circle and can be joined so as to form a ring, wherein the locking crown protrudes over the end region or the upper end of the inner tube section with a locking bead, and wherein an expanding cone for the locking crown that is fixed on the end of a positioning rod and can be axially adjusted to a limited degree is arranged in the inner tube section opposite of the groove for the locking bead.

One decisive aspect for attaining the aforementioned objective is the utilization of an annular, radially adjustable locking crown (with planar force transmitting regions) rather than a spring-loaded arrangement of interlocking balls (with punctual force transmitting regions), wherein said locking crown consists of a suitable material with respect to costs, sliding properties and noise development, preferably of polyamide, and has such dimensions referred to the available inside diameter of the baton tube sections that it adjoins the adjacent inner wall in the installed state. The locking crown is automatically extended and interlocked when the extendable tube sections are "whipped out," namely due to the impact of the locking crown on the expanding cone that practically is arranged stationarily in the baton. In addition, a slight axial adjustment of this expanding cone makes it possible to disengage the interlocked tube sections so as to retract the baton as described in greater detail below.

Advantageous additional developments and embodiments of invention are described below:

A holding bead of the described locking crown has a smaller diameter than the locking bead and is fixed in a circumferential holding groove of the inner tube section. In this case, it would be conceivable to insert a suitable clamping ring into the locking crown, namely in the region of the holding bead that extends radially outward. Suitable embodiments in this respect are described in greater detail below.

In order to disengage the locking crown, the aforementioned positioning rod is advantageously connected to a spring-loaded pushbutton that is arranged in an end cap screwed into the outer tube section, namely such that the pushbutton can be easily accessed and actuated with a finger. In other words, the pushbutton can be easily actuated with the thumb of the hand holding the baton, wherein the baton is then simply retracted with the other hand.

On its extension side, the inner tube section is also provided with an end cap that can be engaged with a locking extension protruding over the expanding cone in the retracted position as described in greater detail below. This measure makes it possible to also secure the baton in the retracted position.

In one preferred embodiment, another tube end section that has a correspondingly reduced diameter and comprises an end cap is arranged in the inner tube section, wherein the inner end of this tube end section is provided with a locking crown that has a correspondingly reduced diameter and adjoins the inside of the inner tube section with its locking bead, wherein said inner tube section is provided with a circumferential locking groove, to which another opposite expanding cone is assigned, and wherein this additional expanding cone is carried by a rod that is supported in the positioning rod in an extendible fashion and extends through the expanding cone. This basically means that the third tube section and the second tube section are interlocked analogous to the above-described engagement between the two tube sections of a two-part baton. In this case, the third tube section still has a relatively large outside diameter.

Sliding rings of a suitable plastic material (preferably also polyamide) are advantageously arranged between the telescopic tube sections in corresponding receptacle grooves so as to simplify the extending and retracting of the baton tube sections and to improve their guidance within one another, as well as to the prevent the admission of dirt, to realize a largely maintenance-free baton design and to minimize the noise development when a baton of this type is extended. In this context, at least one ventilation bore is arranged in the aforementioned end cap that is screwed into the outer tube for pressure compensation purposes.

A preferred three-part baton according to the invention is described in greater detail below with reference to the embodiments illustrated in the figures.

Figure 2:
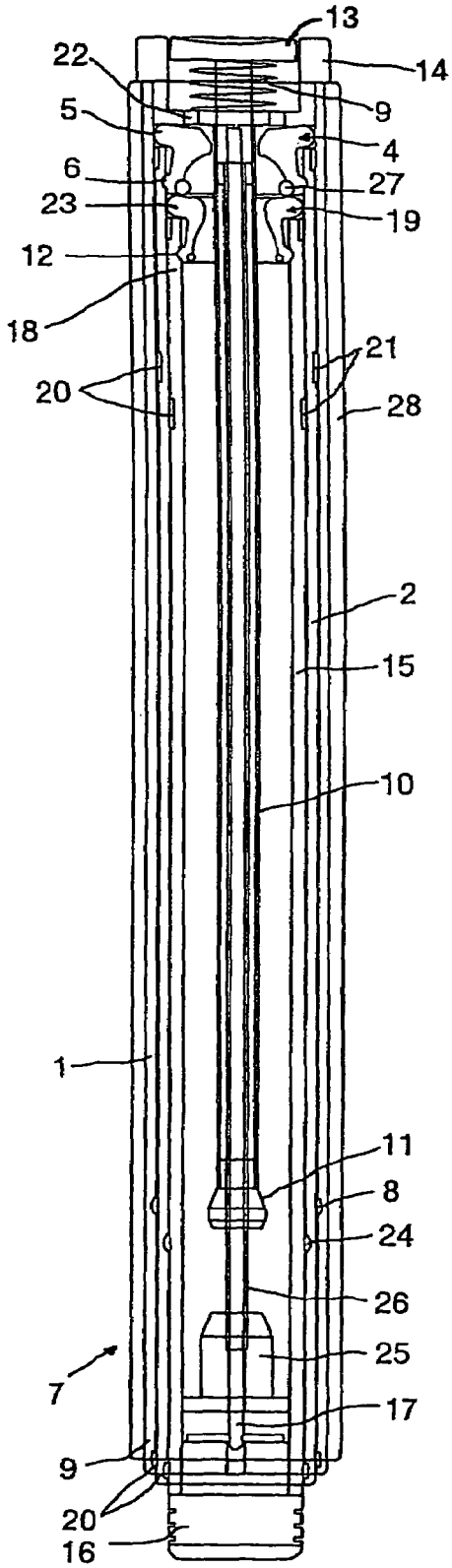
Figure 3:
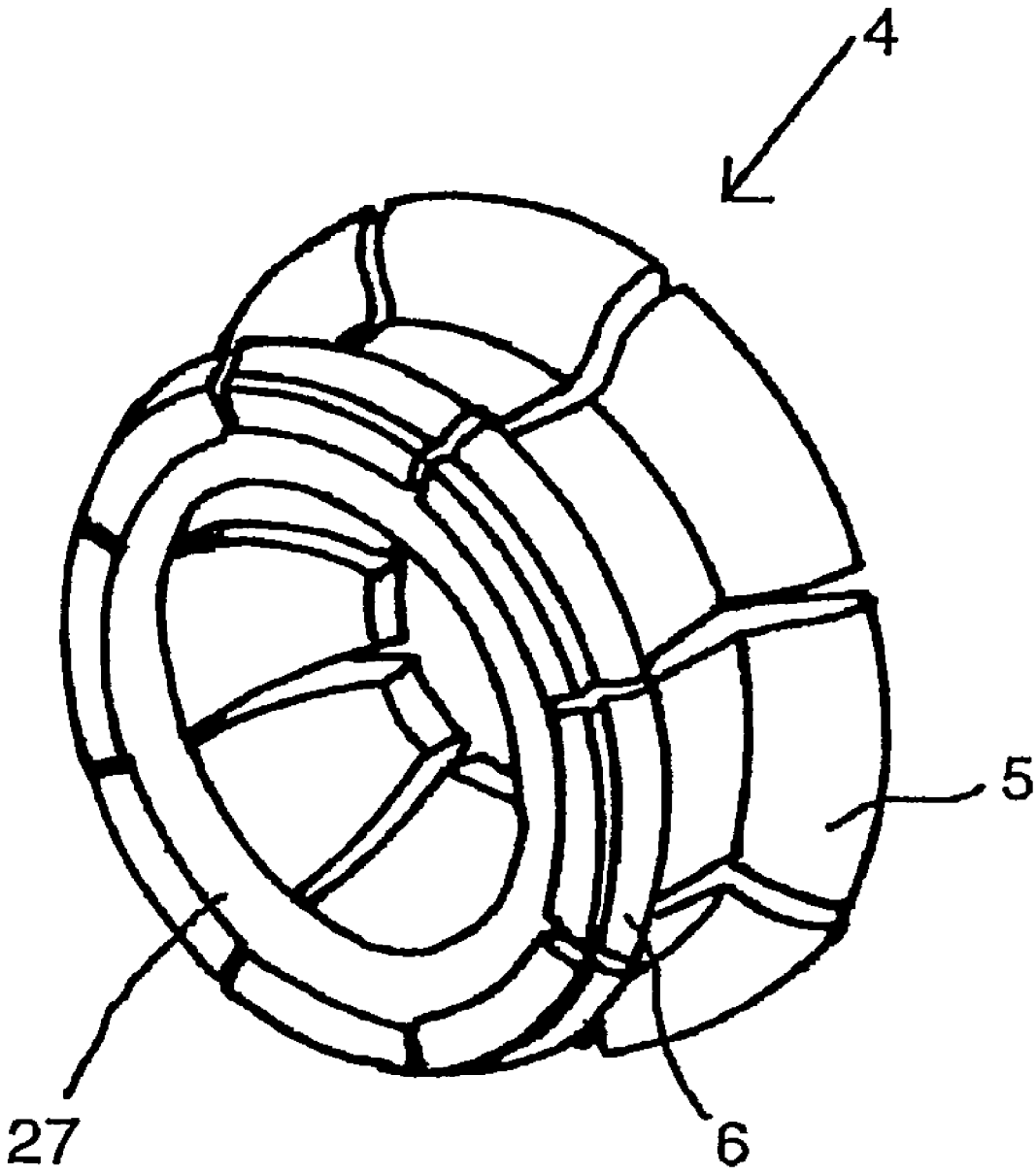

The figures show:

FIG. 1, a section through the baton in the extended state;

FIG. 2, an enlarged representation of the baton according to FIG. 1 in the retracted state, and FIG. 3, an additionally enlarged perspective representation of a locking crown.

The baton consists of at least two tube sections that are telescopically arranged within one another, namely an outer tube section 1 and an inner tube section 2 that can be interlocked in the extended and in the retracted position. In this case, a radially adjustable locking crown 4 is arranged in the end region 3 of the inner tube section 2 that can be retracted into the outer tube section 1, and a circumferential locking groove 8 is arranged on the inside of the end region 7 of the outer tube section 1.

Leaving aside the fact that FIGS. 1 and 2 show a three-part baton, the essential aspects of the baton according to the invention are that the locking crown 4 is composed of a number of (usually and preferably) identical (individual) parts that are realized in the form of sectors of a circle and can be joined so as to form a ring, that the locking crown 4 protrudes over the end region 3 of the inner tube section 2 with a locking bead 5, and that an expanding cone 11 for the locking crown 4 that is fixed on the end of a positioning rod 10 and can be axially adjusted to a limited degree in order to disengage the connection is arranged in the inner tube section 2 opposite of the locking groove 8 for the locking bead 5.

According to FIG. 3, this locking crown 4 is composed of a number of identical individual parts and fixed in a circumferential holding groove 12 of the inner tube section 2 with a holding bead 6 that has a smaller diameter than the locking bead 5. In this case, the fixing or holding tension is generated with the aid of an inserted clamping ring 27 of a suitable material. If a suitable plastic material is chosen, it would also be conceivable to realize the locking crown 4 in one piece, wherein the required axially oriented bead slots are arranged offset relative to one another on the upper and lower end in this case.

The positioning rod 10 is connected to a pushbutton 13 that is under the influence of a spring 9, wherein this pushbutton is arranged, for example, in a pot-shaped end cap 14 screwed into the outer tube section 1 such that it can be easily accessed and actuated. This makes it possible to depress the pushbutton 13 with the thumb of the hand holding the baton as described above in order to disengage the locking crown 4.

On its extension side, the inner tube section 2 is also provided with an end cap 16 that can be engaged with a locking extension 17 protruding over the expanding cone 11 in the retracted position. Since a baton consisting of only two tube sections is not illustrated in the figures, one has to imagine that the elements identified by the reference symbols 19, 25 and 15 in FIG. 1 are eliminated in this case and that the end cap 16 is directly arranged on the free end of the tube section 2. We refer to FIG. 2 with respect to a sensible holding arrangement for this end cap.

FIG. 2 shows the preferred embodiment, in which another tube end section 15 that has a correspondingly reduced diameter and comprises an end cap 16 is arranged in the inner tube section 2, wherein this additional tube end section is provided with a locking crown 19 of correspondingly reduced diameter in its end region 18. This locking crown 19 also adjoins the inside of the inner tube section 2 with its locking bead 23, wherein the inner tube section contains a circumferential locking groove 24, to which another opposite expanding cone 25 is assigned, and wherein this additional expanding cone is carried by a rod 26 that is supported in the positioning rod 10 in an extendible fashion and extends through the expanding cone 11.

Consequently, the interlocking mechanism between the tube end section 15 and the inner tube section 2 essentially corresponds to that between the inner tube section 2 and the outer tube section 1, wherein the interlocked tube sections are disengaged as described above by depressing the pushbutton 13. However, the inner tube section 2 and the tube end section 15 are disengaged by means of the aforementioned rod 26 that, when the baton is retracted, contacts the bottom of the end cap 14 provided with ventilation bores 22 for pressure compensation purposes.

In a two-part as well as a three-part design of the baton, it is advantageous to arrange sliding rings 21 between the respective telescopic tube sections 1, 2 and 2, 15 in corresponding receptacle grooves 20 for the initially cited reasons.

In other respects, the outer tube section 1 is conventionally provided with a coating 28 that has a good grip.

LIST OF REFERENCE SYMBOLS

1 Tube section
2 Tube section
3 End region
4 Locking crown
5 Locking bead
6 Holding bead
7 End region
8 Locking groove
9 Spring
10 Positioning rod
11 Expanding cone
12 Holding groove
13 Pushbutton
14 End cap
15 Tube end section
16 End cap
17 Locking extension
18 End region
19 Locking crown
20 Receptacle groove
21 Sliding ring
22 Ventilation bore
23 Locking bead
24 Locking groove
25 Expanding cone
26 Rod
27 Clamping ring
28 Coating

The invention claimed is:

1. A baton comprising:

at least an outer tube section and an inner tube section telescopically arranged within one another and adapted to interlock in an extended and retracted position;

a radially adjustable locking crown arranged in an end region of the inner tube section, the locking crown adapted to be retracted into the outer tube section; and a circumferential locking groove arranged on an inside region of the outer tube section, wherein:

the locking crown is composed of a number of parts formed as sectors of a circle and adapted to be joined to form a ring, the locking crown protrudes over the end region of the inner tube section with a locking bead, and an axially adjustable expanding cone for the locking crown is fixed on the end of a positioning rod and is arranged in the inner tube section opposite of the circumferential locking groove.

2. The baton according to claim 1, wherein the locking crown is fixed in a circumferential holding groove of the inner tube section with a holding bead that has a smaller diameter than the locking bead.

3. The baton according to claim 1, wherein the positioning rod is connected to a push-button under the influence of a spring and arranged in an end cap screwed into the outer tube section adapted to be easily accessed and actuated.

4. The baton according to claim 1, wherein the inner tube section is provided with an end cap on its extension side, wherein the end cap is adapted to be engaged with a locking extension of the positioning rod that protrudes over the expanding cone in the retracted position.

5. The baton according to claim 1, wherein another tube end section comprising a correspondingly reduced diameter and an end cap is arranged in the inner tube section, the another tube end section provided with a locking crown of correspondingly reduced diameter in a retractable end region, the inner tube section contains a circumferential locking groove, and another opposite expanding cone is arranged to the locking groove and carried by a rod adapted to be supported in the positioning rod in an extendible fashion and extends through the expanding cone.

6. The baton according to claim 1, wherein the locking crown comprises a one piece structure constructed of a material with limited elasticity.

7. The baton according to claim 2, wherein both sides of the locking crown are provided with equidistant slots that divide the locking and holding beads.

8. The baton according to claim 1, wherein sliding rings are arranged between the outer tube section and the inner tube section in corresponding receptacle grooves.

9. The baton according to claim 1, wherein fixing or holding tension is generated with the aid of a clamping ring constructed of a material adapted to be inserted into the locking crown.

10. The baton according to claim 1, wherein at least one ventilation bore is provided in an end cap screwed into the outer tube section for pressure compensation purposes.

11. The baton according to claim 6, wherein the material is polyamide.

* * * * *